United States Patent [19]

Howorth

[11] 4,057,861

[45] Nov. 15, 1977

[54] MATTRESS

[75] Inventor: Frederick Hugh Howorth, Chorley, England

[73] Assignee: Howorth Air Engineering Limited, Bolton, England

[21] Appl. No.: 696,944

[22] Filed: June 17, 1976

[30] Foreign Application Priority Data

June 28, 1975 United Kingdom ..... 27431/75

[51] Int. Cl.[2] ..... A47C 23/00; A47C 25/00; A47C 27/00

[52] U.S. Cl. ..... 5/365; 5/91; 5/345 R; 5/347

[58] Field of Search ..... 5/91, 345 R, 347, 284; 297/453

[56] References Cited

U.S. PATENT DOCUMENTS

| | | | |
|---|---|---|---|
| 2,815,516 | 12/1957 | Holton | 5/91 |
| 3,486,177 | 12/1969 | Marshack | 5/347 |
| 3,529,310 | 9/1970 | Olmo | 5/347 |
| 3,778,851 | 12/1973 | Howorth | 297/453 |

FOREIGN PATENT DOCUMENTS

| | | | |
|---|---|---|---|
| 211,894 | 4/1967 | Sweden | 5/345 R |
| 1,350,110 | 4/1974 | United Kingdom | 5/91 |

*Primary Examiner*—Paul R. Gilliam
*Assistant Examiner*—Kenneth J. Dorner
*Attorney, Agent, or Firm*—Ross, Ross & Flavin

[57] ABSTRACT

This invention relates to a mattress to which conditioned air can be supplied to issue from the mattress to impinge upon and pass around the body of a person so as to wholly or partly enclose the person in a microclimate to promote healing or maintain the health of the person. A supply of conditioned air to a person can be of great assistance in the prevention of bed sores and can greatly encourage the healing of burns. Further the provision of a supply of warm air to, say, an elderly person at home during sleeping can be of great assistance in the prevention of hypothermia.

1 Claim, 1 Drawing Figure

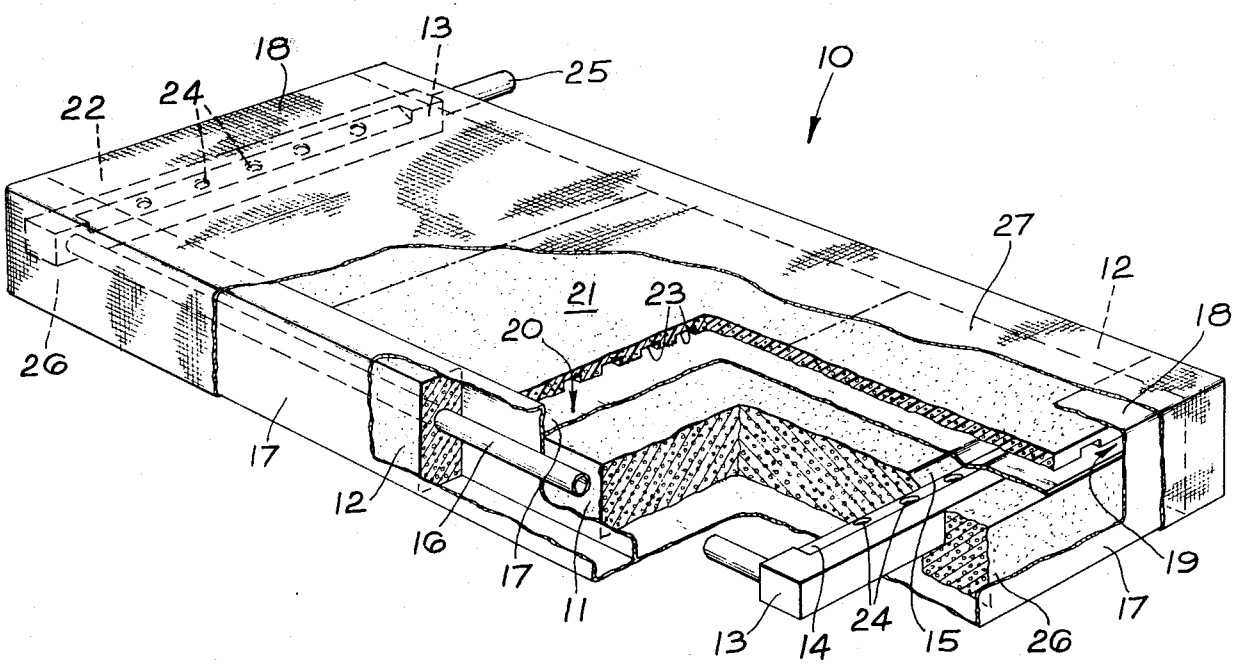
10
11
12
13
14
15
16
17
18
19
20
21
22
23
24
25
26
27

MATTRESS

An object of the invention is to provide an improved mattress to which conditioned air can be supplied.

Accordingly, the invention provides a mattress comprising a base having its upper surface covered by air-impermeable waterproof material and an overlay of air-permeable air-diffusing material on top of the base, at least one of the upper surface of the base and the lower surface of the overlay being shaped to provide air passages between the base and the overlay, and air delivery means for delivering air to the passages.

The overlay is effective to allow air passing from the passages to the upper surface of the overlay to be diffused generally evenly over its surface. To this end, the overlay can be of fibrous material, but preferably is a layer of open-cell foamed plastics or rubber material.

The support can be a block of foamed plastics or rubber. Alternatively, the support can be inflatable, or can be constituted by a flexible container full of beads, for example of expanded polystyrene, to assist in spreading the areas of pressure on a user. The air flow passages can be formed in the overlay or of the base, or both. Preferably, however, the channels are formed in the underside of the overlay and the top of the base is planar. The mattress preferably includes means for locating the overlay on the base and such means can comprise resilient members extending along each longitudinal edge of the base and of greater thickness than the base. These members can contain flexible tubes connecting air supply manifolds at the ends of the mattress. One of the manifolds can have a connection for an air supply.

Conveniently a cover, of air permeable material, overlies the overlay.

The invention will be described further, by way of example, with reference to the accompanying drawing, wherein the single figure is a perspective, part fragmentary view of a preferred embodiment of mattress conforming to the invention.

A preferred embodiment of mattress 10 conforming to the invention comprises a base 11 in the form of a rectangular block of foamed plastics material 147 cm long, 71 cm wide, and 12.5 cm thick. Along each longer edge of the base 11 is disposed a lateral member 12 in the form of a strip of foamed plastics material 15 cm × 7.5 in cross-section. Across each end of the base 11 extends a generally L-sectioned transverse member 26 which supports a minifold 13 in the form of a rigid generally rectangularly sectional tube. The top surfaces of the manifolds 13 lie level with the top surface of the base 11 and, facing the base, are chamfered at 14, as is the base at 15, for a purpose to be later described. Extensions of the lateral members 12 enclose end portions of the manifolds 13.

Each lateral member 12 has a longitudinally extending central circular aperture which accommodates a flexible conduit 16 connecting the respective ends of the manifolds 13.

The base 11, lateral members 12 and manifolds are enclosed in an air-impermeable waterproof washable envelope 17 of synthetic plastics material and end flaps 18 of the material extend between the lateral members 12 above the manifolds 13 to form pockets 19 whose purpose will be later described. Because the lateral members 12 are thicker than the base 11 they define therewith a recess 20 and serve to retain an overlay 21 on top of the base 11.

The overlay 21 is of open-cell foamed plastics material 147 cm long, 71 cm wide and 25 cm thick and overlies the base 11 between the lateral members 12. Its end portions 22 are received in the pockets 19.

In the underside of the overlay 21, are formed five equally spaced air passages 23 extending longitudinally. Each passage is in the form of a channel 3 cm wide by 1 cm deep, and each end of each channel, adjacent its closure, overlies an aperture 24 some 2 cm in diameter in the underlying manifold. The chamfered top portion 14 of the manifold 13 in which the apertures are provided, i.e. that portion adjacent the base 11, places the apertures 24 slightly below the level of the top of the base 11. This minimises the possibility of a person on the mattress 10 accidentally closing one or more of the apertures 24 by applying localized pressure to the overlay 21.

One of the manifolds 13 has a spigot 25 extending out of the envelope for connection to a supply of air which is heated or cooled and is filtered to remove bacteria therefrom. The air supply required is some 0.8 – 1.3 cm/min, preferably about 1.0 cm/min. A light cover 27, for example of knitted fabric, can be fitted to the whole mattress.

The mattress of the invention is effective in supplying conditioned air to a person thereon, is dimensioned to be similar in size, shape and appearance to a conventional mattress and can be cleaned easily after soiling.

In this latter respect it will be realised that if the overlay 21 is siled, it is necessary only for the cover to be removed, the overlay removed, the waterproof envelope cleaned by sponging and a new or washed overlay and cover replaced.

The invention is not limited to the precise details of the foregoing and variations can be made thereto. For example the base can be shaped to provide the passages, allowing the overlay to be a plain sheet of foamed plastics material, thus facilitating the provision of replacement overlays.

The passages can extend across the mattress instead of or as well as longitudinally thereof, although it must always be ensured that air is supplied to substantially the entire area of the upper layer. Supply can be from one or both ends, from the sides, or from any combination of these positions. The base can be inflatable, or can be a flexible envelope filled with beads or the like, for example of expanded polystyrene.

If desired the overlay can be in two or more parts. In particular, if the overlay is in three sections, as indicated by the dotted lines 28, the middle section, obviously most prone to soiling, can be removed and discarded.

I claim:

1. A mattress comprising: a base member dimensioned and constructed to be capable of providing support for a patient;

an air-impermeable waterproof covering over the upper surface of the base member to prevent ingress of body fluids to the interior of the base member;

A removable diffuser of air-permeable open-celled foam material overlaying and supported by the upper surface of the base member;

air distribution passages between the upper surface of the diffuser and the waterproof covering arranged to enable conditioned air to be supplied to a substantial part of the diffuser for issuing from the surface of the diffuser, the air distribution passages being constituted by channels formed in at least one of the underside of the diffuser and the upper surface of the base; and air supply means for conducting conditioned air from a source to the channels to be distributed by the passages and issue from the upper surface of the overlay to impinge upon and pass around a patient lying on the mattress.

* * * * *